US008824908B2

(12) United States Patent
Aoki

(10) Patent No.: US 8,824,908 B2
(45) Date of Patent: Sep. 2, 2014

(54) INFORMATION PROCESSING APPARATUS FOR DETERMINING A HEIGHT OF A TONER IMAGE FORMED ON AN IMAGE BEARING MEMBER, INFORMATION PROCESSING METHOD, AND IMAGE FORMING APPARATUS

(75) Inventor: Kunitoshi Aoki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 123 days.

(21) Appl. No.: 13/302,347

(22) Filed: Nov. 22, 2011

(65) Prior Publication Data

US 2012/0134689 A1 May 31, 2012

(30) Foreign Application Priority Data

Nov. 30, 2010 (JP) ..... 2010-267291
Aug. 26, 2011 (JP) ..... 2011-184617

(51) Int. Cl.
*G03G 15/00* (2006.01)

(52) U.S. Cl.
USPC ..... 399/49; 399/15

(58) Field of Classification Search
USPC ..... 399/15, 49, 74
See application file for complete search history.

(56) References Cited

U.S. PATENT DOCUMENTS 6,853,817 B2 * 2/2005 Suzuki ..... 399/49
6,879,788 B2 * 4/2005 Ito et al.
6,985,678 B2 * 1/2006 Maebashi et al. ..... 399/39
7,512,349 B2 * 3/2009 Itoh et al. ..... 399/38
7,557,960 B2 * 7/2009 Ishida et al. ..... 358/3.02
2003/0231350 A1 * 12/2003 Yamagishi ..... 358/3.06
2005/0117928 A1 * 6/2005 Hino ..... 399/49
2006/0188276 A1 * 8/2006 Nishida et al. ..... 399/49
2007/0237533 A1 * 10/2007 Hanashi et al. ..... 399/49
2007/0292146 A1 * 12/2007 Takesue et al. ..... 399/9
2008/0075476 A1 * 3/2008 Nakazato et al. ..... 399/15
2010/0021196 A1 * 1/2010 Atsumi et al. ..... 399/74
2010/0247125 A1 * 9/2010 Akita ..... 399/49
2010/0266302 A1 * 10/2010 Suzuki et al. ..... 399/49
2010/0310284 A1 * 12/2010 Funato et al. ..... 399/302
2010/0322648 A1 * 12/2010 Kojima et al. ..... 399/49
2011/0158668 A1 * 6/2011 Fuse et al. ..... 399/49
2011/0188056 A1 * 8/2011 Muto ..... 356/630
2011/0200347 A1 * 8/2011 Hirobe ..... 399/49
2012/0106997 A1 * 5/2012 Aoki ..... 399/49

FOREIGN PATENT DOCUMENTS

JP 4-156479 A 5/1992
JP 09236939 A * 9/1997
JP 2001194851 A * 7/2001
JP 2006139180 A * 6/2006

* cited by examiner

*Primary Examiner* — David Bolduc
(74) *Attorney, Agent, or Firm* — Canon USA, Inc., IP Division

(57) ABSTRACT

An information processing apparatus capable of determining a height of a toner image formed on an image bearing member with high accuracy includes detecting a two-dimensional reflection image corresponding to a reflection image of a beam from the toner image formed on the image bearing member, identifying a representative position based on the detected two-dimensional reflection image, and determining the height of the toner image based on the identified representative position.

13 Claims, 17 Drawing Sheets

INFORMATION PROCESSING APPARATUS FOR DETERMINING A HEIGHT OF A TONER IMAGE FORMED ON AN IMAGE BEARING MEMBER, INFORMATION PROCESSING METHOD, AND IMAGE FORMING APPARATUS

BACKGROUND OF THE INVENTION

1. Field of the Invention

The present invention relates to an information processing apparatus for determining a height of a toner image formed on an image bearing member, an information processing method, and an image forming apparatus.

2. Description of the Related Art

A color of an image formed by an electro-photographic image forming apparatus, e.g., a copying machine, a laser printer, and a fax machine, varies according to changes of various kinds of physical parameters even when settings of the apparatus in image formation are the same. More specifically, the change in the physical parameters in a developing/transferring process tends to be a factor of a color variation.

This is because, the physical parameters, e.g., a latent image potential, a toner replenishment amount, and a transfer efficiency varies according to an environmental fluctuation of, for example, a temperature and humidity, and thus toner adhesion amounts to be adhered to a photosensitive drum and a transfer belt vary.

Therefore, stabilization of the developing/transferring process is required. The stabilization is realized in such a manner that the toner adhesion amounts on the photosensitive drum or the transfer belt is measured and, and based on the measurement result, an amount of exposure, a developing voltage, and a transfer current are controlled.

Generally, these controls are executed when the environmental fluctuation occurs, e.g., after an exchange of a toner cartridge, after printing of a predetermined number of sheets, and after power of a body of the image forming apparatus is turned on. When measuring the toner adhesion amounts, a plurality of toner images (i.e., toner patches) having various densities, i.e., from a low density to a high density, are formed on the photosensitive drum and the transfer belt. Subsequently, the toner adhesion amount measurement device measures the toner adhesion amounts of the toner images and performs various controls under proper image forming conditions based on the measurement result.

A typical toner adhesion amount measurement device emits light from an LED light source and detects a light quantity of reflected light reflected on the toner image, thereby measuring the toner adhesion amount. According to another method, a physical form of the toner image (i.e., a thickness of the toner image, namely, a toner height) is measured by a profilometer including a laser displacement meter.

Japanese Patent Application Laid-open No. 04-156479 discusses a measurement method in which a toner image formed on each of a photosensitive drum and a transfer belt is irradiated with a laser beam and reflected light therefrom is captured by a line sensor including light-sensitive elements arranged in line, thereby measuring the toner height.

The toner height of the toner image formed on a image bearing member such as the photosensitive drum and the transfer belt is extremely low, i.e., from a several micrometers to about ten micrometers, in the electro-photographic image forming apparatus. Therefore, in order to measure the toner height by using the profilometer, detection of a minute step between a surface of the image bearing member and a surface of the toner image, is required. However, in the conventional method, e.g., a method discussed in Japanese Patent Application Laid-open No. 04-156479, the toner height could not be detected with high accuracy.

SUMMARY OF THE INVENTION

The present invention is directed to an information processing apparatus for determining a height of a toner image formed on an image bearing member with high accuracy.

According to an aspect of the present invention, an information processing apparatus for determining a height of a toner image formed on a image bearing member includes a first obtaining unit configured to obtain a first two-dimensional image data, that can be obtained by capturing a beam emitted from an emission unit and reflected on the toner image, by using a two-dimensional sensor, a first detecting unit configured to detect a first two-dimensional reflection image corresponding to a reflection image of the beam in the toner image from the first two-dimensional image data obtained by the first obtaining unit, a first identification unit configured to identify a first representative position of the first two-dimensional reflection image from the first two-dimensional reflection image detected by the first detecting unit, and a determination unit configured to determine the height of the toner image from a first representative position identified by the first identification unit.

According to the present invention, the height of the toner image formed on the image bearing member, e.g., the photosensitive drum and the transfer belt, can be determined with high accuracy.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

In a first exemplary embodiment, a case where a laser diode is used as a light source is described below.

Figure 1A:
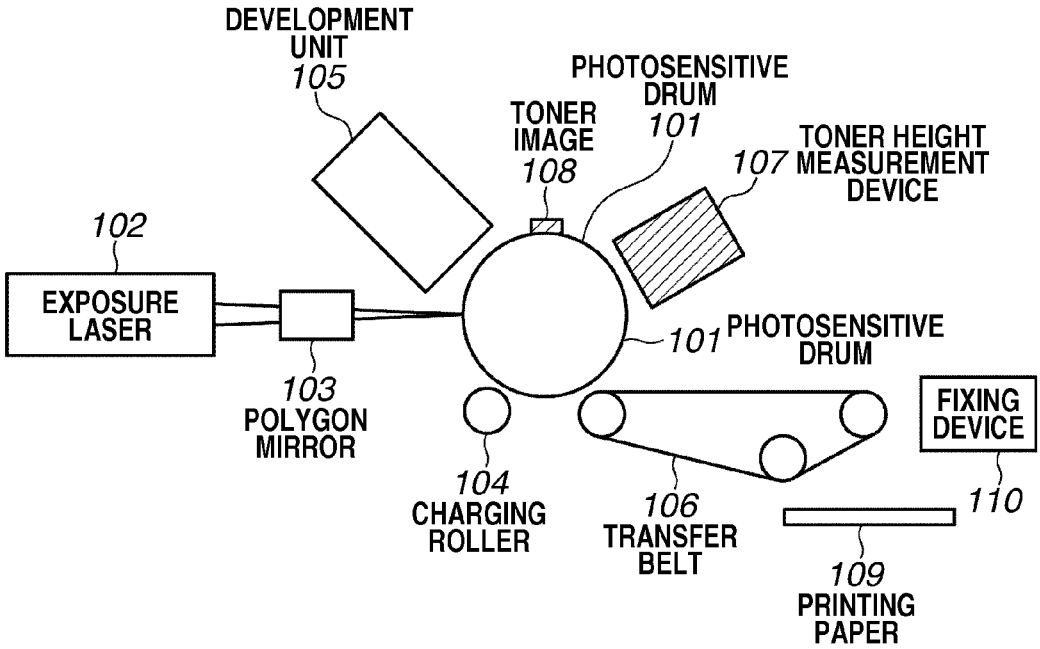
FIGS. 1A and 1B illustrates a configuration of an image forming apparatus.
Figure 1B:
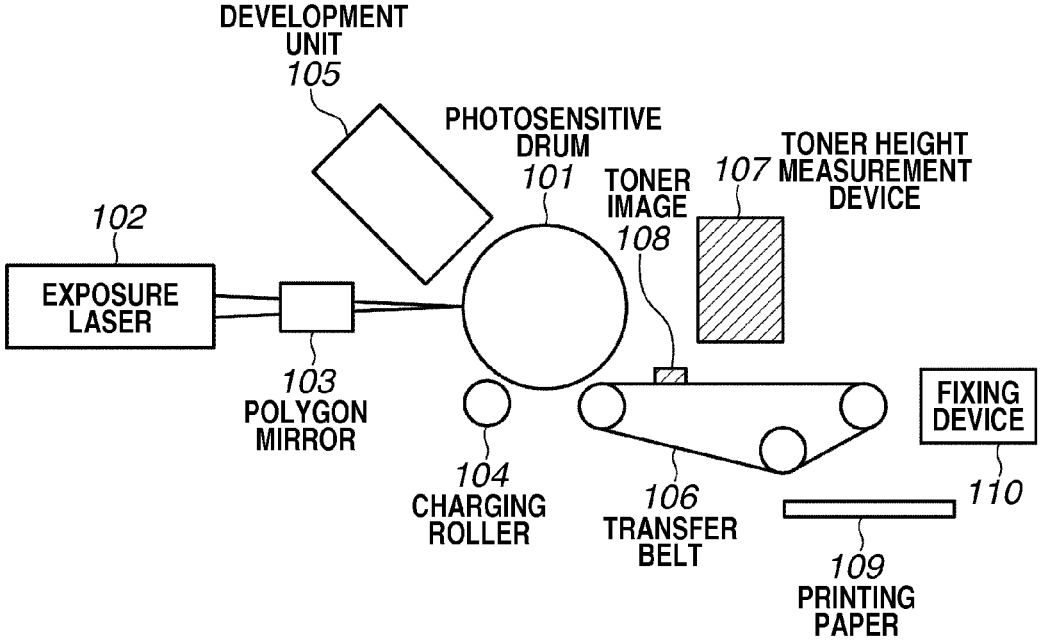

FIGS. 1A and 1B each illustrate a configuration of an electro-photographic image forming apparatus according to the first exemplary embodiment and second through fifth exemplary embodiments described below. The image forming apparatus of FIG. 1A includes a photosensitive drum 101, an exposure laser 102, a polygon mirror 103, a charging roller 104, a development unit 105, a transfer belt 106, a toner height measurement device 107, a fixing device 110, and the like.

The image forming apparatus charges a surface of the photosensitive drum 101 by using the charging roller 104 and generates an electrostatic latent image by using the exposure laser 102 and the polygon mirror 103. The image forming apparatus forms a toner image 108 on the photosensitive drum 101 by using the development unit 105 and measures a toner height of the toner image 108 after it is developed by using the toner height measurement device 107. After the measurement of the toner height, the toner image 108 is sequentially transferred to the transfer belt 106 and a printing paper 109, fixed by the fixing device 110, and output as a printed product.

As illustrated in FIG. 1B, the measurement of the toner height of the toner image 108 may be performed on the transfer belt 106 after the toner image 108 is transferred from the photosensitive drum 101 to the transfer belt 106. The photosensitive drum 101 and the transfer belt 106 carry the toner image 108, so that the photosensitive drum 101 and the transfer belt 106 are hereinafter collectively referred to as an image bearing member 101/106.

Figure 2:
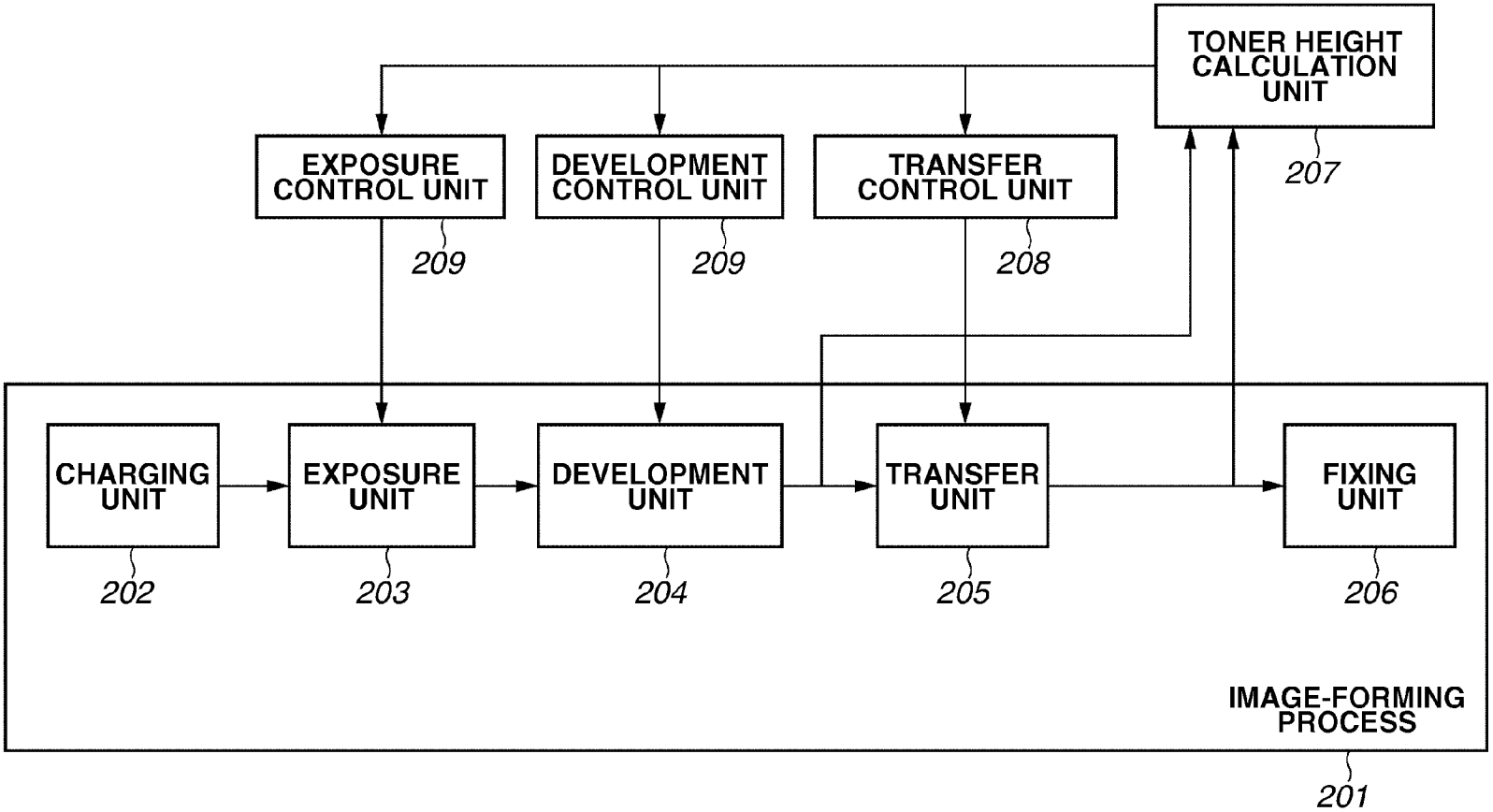
FIG. 2 is a block diagram illustrating a control of an image-forming process.

FIG. 2 is a block diagram illustrating the control of image-forming process 201 performed by a toner height calculation unit 207. The toner height calculation unit 207 determines the toner height after development by a development unit 204 or after transfer by a transfer unit 205. The toner height calculation unit 207 feeds back the determined toner height to a transfer control unit 208, a development control unit 209, and an exposure control unit 210, respectively.

Each of the transfer control unit 208, the development control unit 209, and the exposure control unit 210 controls a process based on the fed back toner height. For example, the transfer control unit 208 corrects a transfer current, the development control unit 209 corrects a development bias voltage and a toner replenishment amount, and the exposure control unit 210 corrects a gradation γ characteristic, respectively, to a proper setting value according to the determined toner height.

Figure 3:
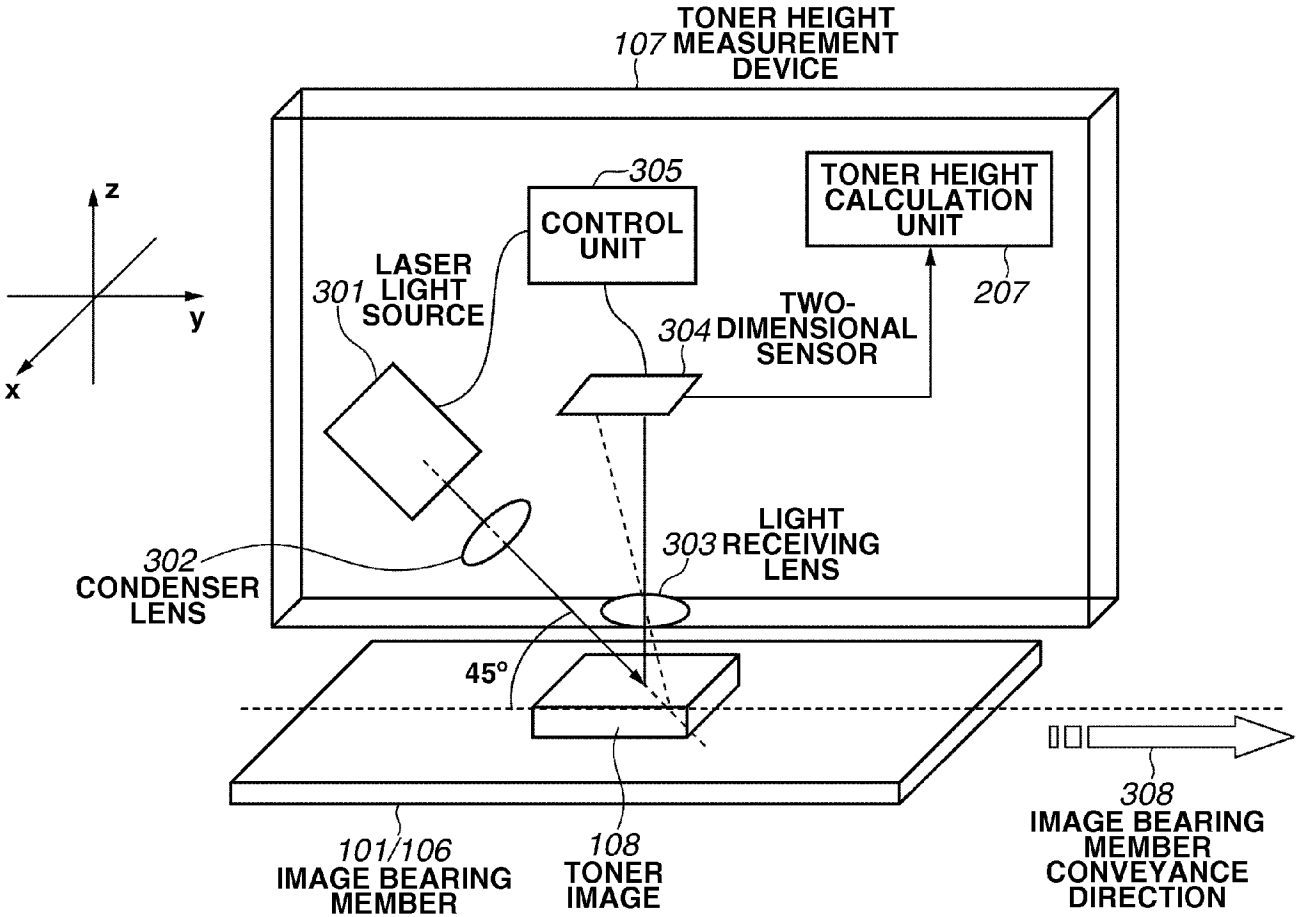
FIG. 3 illustrates a positional relationship among a toner height measurement device, an image bearing member, and a toner image.

FIG. 3 illustrates the positional relationship of the toner height measurement device 107 with respect to the image bearing member 101/106 and the toner image 108.

A control unit 305 controls a laser light source 301 to thereby irradiate a surface of the image bearing member 101/106 and the toner image 108 via a condenser lens 302. The laser beam exists on a y-z plane taking an angle of 45° with respect to a negative y-axis (i.e., laser beam incident angle θ).

The reflected laser beam forms an image on a two-dimensional sensor 304 via a light receiving lens 303 arranged in a vertical direction with respect to a reflection surface (i.e., positive z-axis direction). An image of the reflected light of the laser beam on the image bearing member 101/106 or the toner image 108 captured by a two-dimensional sensor 304, is hereinafter referred to as two-dimensional reflection image.

Figure 12:
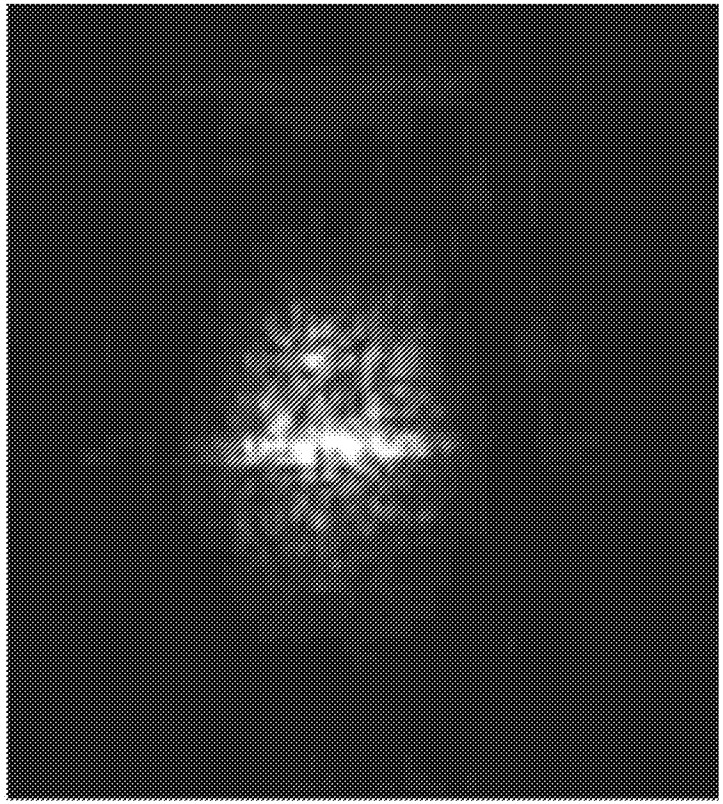
FIG. 12 illustrates two-dimensional image data captured by a two-dimensional sensor.

The two-dimensional sensor 304 captures images of the image bearing member 101/106 and the toner image 108 to obtain two-dimensional image data indicative of the two-dimensional reflection image. FIG. 12 illustrates the two-dimensional image data obtained by the two-dimensional sensor 304. A white portion in FIG. 12 is the two-dimensional reflection image.

The control unit 305 transmits the obtained two-dimensional image data from the two-dimensional sensor 304 to the toner height calculation unit 207. The toner height calculation unit 207 determines the toner height by executing the signal processing described below. Examples of the two-dimensional sensor 304 include an area-type Charge-Coupled Device (CCD) sensor and an area-type Complementary Metal-Oxide Semiconductor (CMOS) sensor.

Figure 4A:
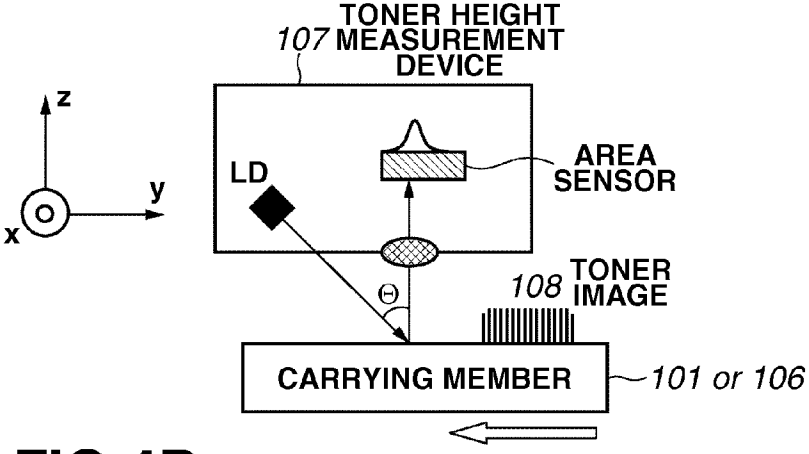
FIGS. 4A to 4D illustrate a procedure for measuring the toner height.
Figure 4B:
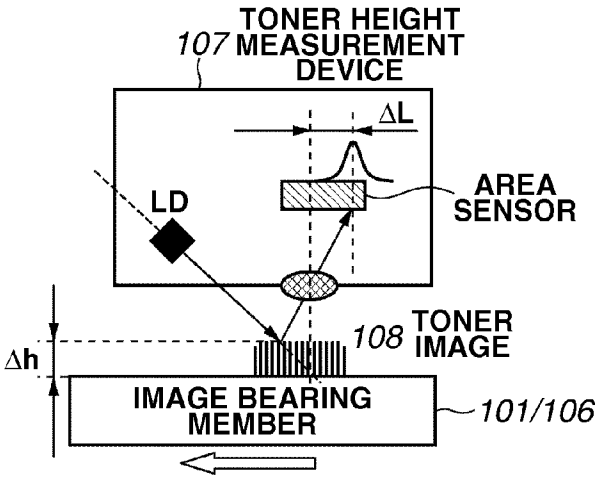
Figure 4C:
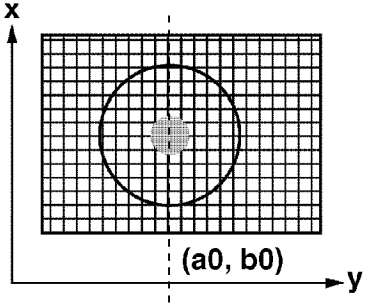

FIGS. 4A through 4D each illustrate a step of measuring the toner height and two-dimensional image data captured by the two-dimensional sensor 304. When the two-dimensional sensor 304 measures the toner height, as illustrated in FIG. 4A, while the laser beam irradiates a surface portion of the image bearing member 101/106 on which no toner image 108 is formed, the two-dimensional sensor 304 captures the light reflected on the surface of the image bearing member 101/106 to obtain the two-dimensional image data (FIG. 4C).

Subsequently, the image bearing member 101/106 is driven in order to move a position at which the laser beam irradiates the toner image 108 (FIG. 4B). Then, the two-dimensional sensor 304 captures the light reflected on the toner image 108 to obtain the two-dimensional image data (FIG. 4D).

Figure 4D:
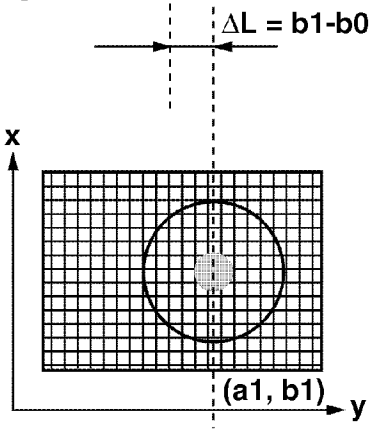

As illustrated in FIGS. 4C and 4D, the two-dimensional reflection image moves in a Y-axis direction according to a change of the toner height (i.e., change between a case where there is the toner image and a case where there is no toner image). By using this phenomenon, the toner height calculation unit 207 determines the toner height based on the two-dimensional image data including the reflection image on the surface of the image bearing member 101/106 (FIG. 4B) and the two-dimensional image data including the reflection image on the surface of the toner image 108 (FIG. 4D).

Figure 5:
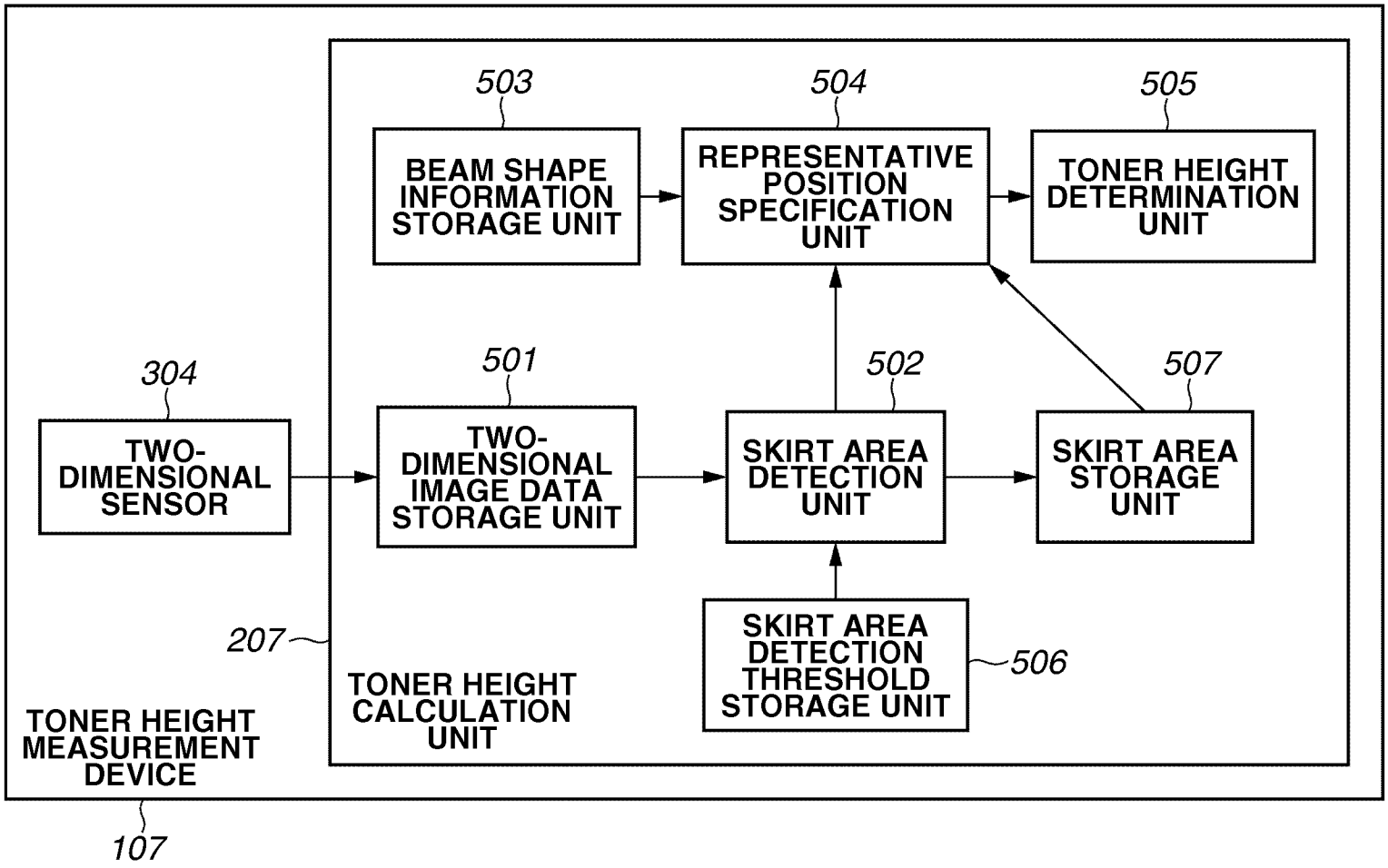
FIG. 5 is a block diagram illustrating a configuration of the main part of the toner height measurement device.
Figure 6:
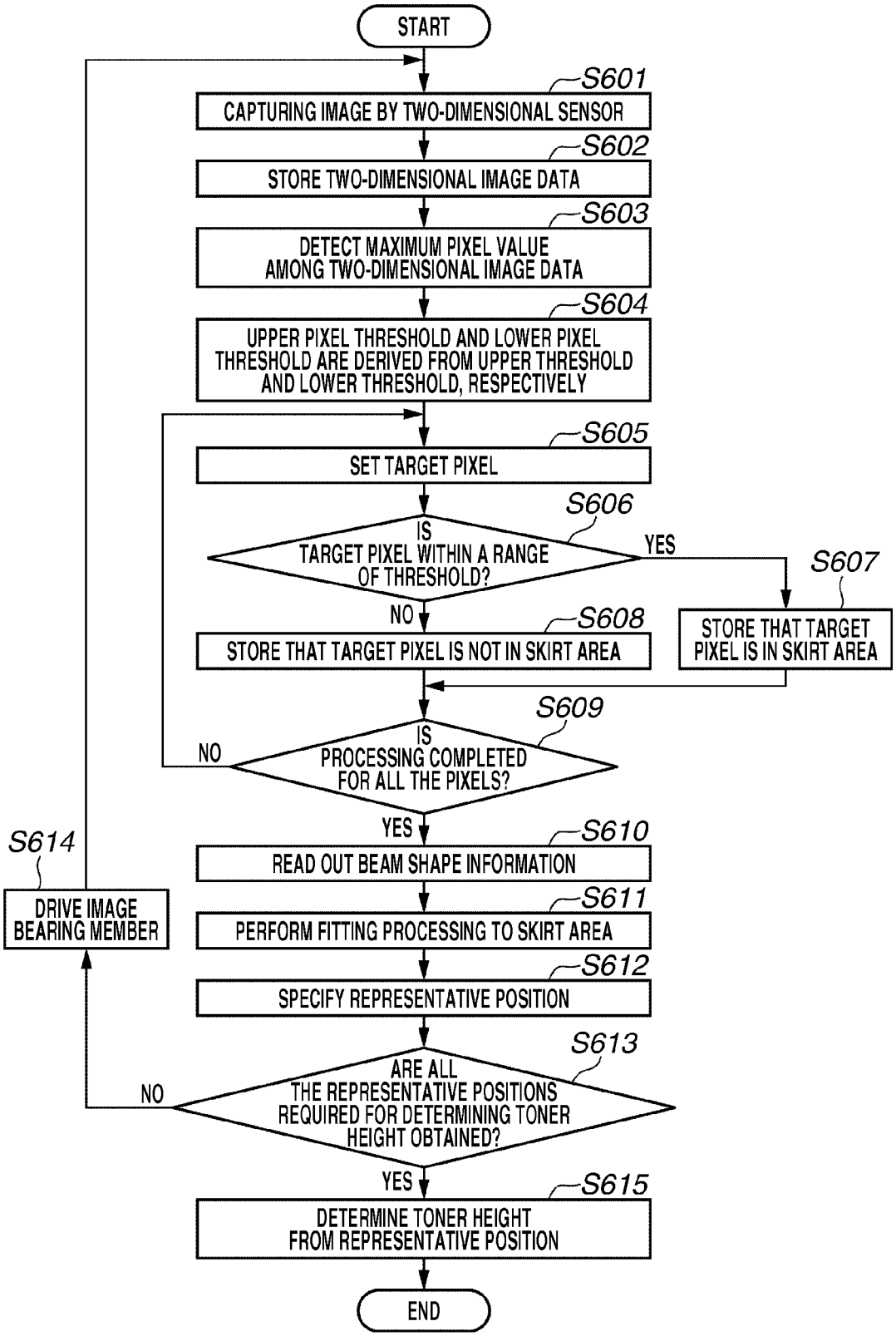
FIG. 6 is a flowchart illustrating a flow of processing performed by a toner height calculation unit.

FIG. 5 is a block diagram illustrating a configuration of the main part of the toner height measurement device 107. FIG. 6 illustrates a flow of processing performed by the toner height measurement device 107. FIGS. 7A through 7E illustrate data obtained or identified by each processing of FIG. 6. Determination processing of the toner height is described below with reference to FIG. 5 and FIGS. 7A through 7E.

Figure 7A:
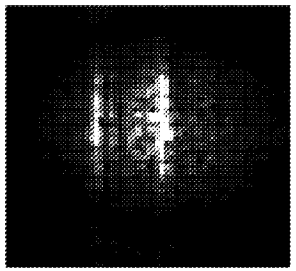
FIGS. 7A to 7E illustrate data obtained or identified in each processing performed by the toner height calculation unit.

In step S601, the two-dimensional sensor 304 captures the two-dimensional reflection image of the image bearing member 101/106 or the toner image 108, and generates the two-dimensional image data including the two-dimensional reflection image. FIG. 7A illustrates an image indicated by the two-dimensional image data wherein a white portion in the image corresponds to the two-dimensional reflection image.

The two-dimensional sensor 304 outputs the generated two-dimensional image data into a two-dimensional image data storage unit 501. In step S602, the two dimensional image data storage unit 501 stores the two-dimensional image data output from the two-dimensional sensor 304.

In view of the irradiation characteristic of the laser beam, a distribution of pixel values of the two-dimensional reflection image is the Gaussian distribution. However, the surfaces of the image bearing member 101/106 and the toner image 108 include minute surface asperities and streaky scratches due to a rotation in a circumferential direction, which varies a reflectance according to a sampled position. Therefore, the distribution of the pixel values of the two-dimensional reflection image includes an error.

In the present exemplary embodiment, in order to reduce an adverse effect of this error, a skirt area detection unit 502 detects a skirt area made of a set of pixels having pixel values within a range of a predetermined threshold. The detected skirt area is regarded as a skirt area of the Gaussian distribution, thereby calculating a peak position of the Gaussian distribution. Setting this peak position to a representative position of the two-dimensional reflection image of the laser beam enables a reduction of an adverse effect produced by the error, resulting in achieving a measurement of the toner height with high accuracy.

In step S603, the skirt area detection unit 502 detects the maximum pixel value A in the two-dimensional image data stored in the two-dimensional image data storage unit 501. In step S604, the skirt area detection unit 502 reads out an upper threshold $R_{max}$ and a lower threshold $R_{min}$ from a skirt area detection threshold storage unit 506 storing the upper threshold $R_{max}$ and the lower threshold $R_{min}$. Based on the following equation, an upper pixel threshold $Th_{max}$ and a lower pixel threshold $Th_{min}$ are derived.

$$Th_{max}=R_{max}\times A \quad (1)$$

$$Th_{min}=R_{min}\times A \quad (2)$$

In step S605, the skirt area detection unit 502 sets a target pixel in the two-dimensional image data. An initial value of the target pixel is set to an upper-left pixel of the two-dimensional image data and, every time the subsequent processing from step S606 to step S609 is completed, a pixel positioned right to the target pixel having been processed is set to a new target pixel. In a case where the processing is completed with respect to the pixel at a right end of the two-dimensional image data, a pixel at a left end of a next scanning line becomes a new target pixel.

In step S606, the skirt area detection unit 502 determines whether or not the pixel value of the target pixel exists between the upper pixel threshold $Th_{max}$ and the lower pixel threshold $Th_{min}$ derived in step S604 (i.e., threshold value processing). In a case where the skirt area detection unit 502 determines that the pixel value of the target pixel exists between the upper pixel threshold $Th_{max}$ and the lower pixel threshold $Th_{min}$ (YES in step S606), the processing proceeds to step S607. In a case where the skirt area detection unit 502 determines that the pixel value of the target pixel is outside a range between the upper pixel threshold $Th_{max}$ and the lower pixel threshold $Th_{min}$ (NO in step S606), the processing proceeds to step S608.

In step S607, the skirt area detection unit 502 causes the skirt area storage unit 507 to store information indicating that the target pixel is a part of the skirt area of the two-dimensional reflection image. On the other hand, in step S608, the skirt area detection unit 502 causes the skirt area storage unit 507 to store information indicating that the target pixel is not a part of the skirt area of the two-dimensional reflection image.

Figure 7B:
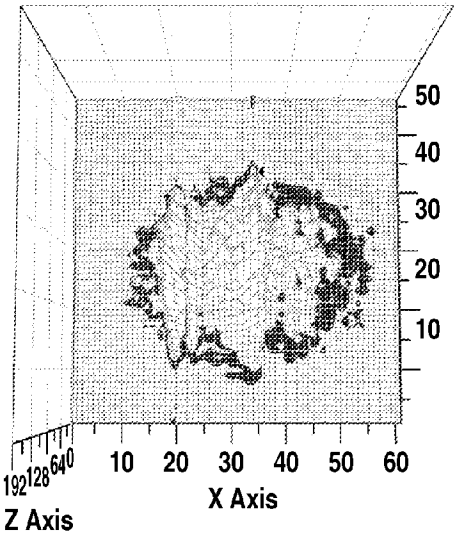
Figure 7C:
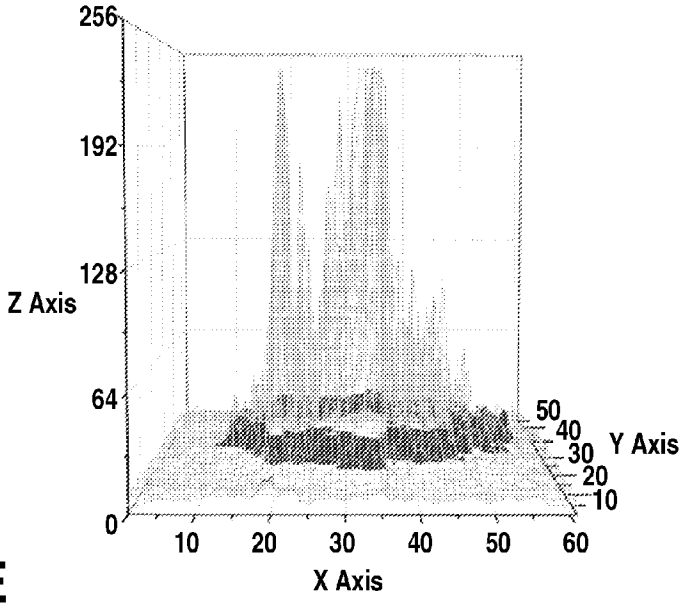
Figure 7D:
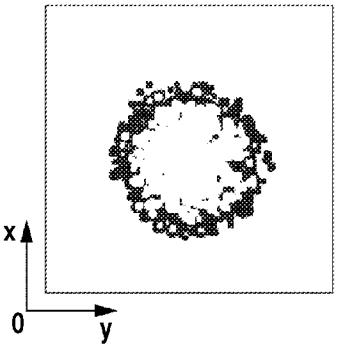

FIGS. 7B and 7C illustrate a correspondence between the two-dimensional image data (x-axis, y-axis) and the pixel value (z-axis), respectively. In FIGS. 7B and 7C, pixels in black are pixels of the skirt area of the two-dimensional reflection image in step S607. As a result of the processing of steps S607 and S608, the skirt area storage unit 507 stores two-dimensional reflection image data indicating whether or not each of the pixels is a part of the skirt area of the two-dimensional reflection image. FIG. 7D illustrates the skirt area indicated by the two-dimensional reflection image data stored in the skirt area storage unit 507.

In step S609, the skirt area detection unit 502 determines whether or not the processing from step S605 to step S607 (or step S608) is completed with respect to all the pixels of the two-dimensional image data. In a case where the skirt area detection unit 502 determines that the processing is not completed with respect to all the pixels of the two-dimensional image data (NO in step S609), the processing returns to step S605, and the processing continues after setting the target pixel to a pixel next to the target pixel. On the other hand, in a case where the skirt area detection unit 502 determines that the processing is completed with respect to all the pixels of the two-dimensional image data (YES in step S609), the processing proceeds to step S610.

In step S610, a representative position specification unit 504 reads out beam shape information stored in a beam shape information storage unit 503. The beam shape information includes the fitting function indicative of the following circle.

$$(x-a)^2+(y-b)^2=r^2 \quad (3)$$

Here, (x, y) represents pixel positions of the pixels of the skirt area, (a, b) represents a center position of the skirt area, and r represents a radius of the skirt area, respectively.

A unit of each of x, y, a, b, and r is a pixel.

In step S610, a representative position specification unit 504 performs fitting processing by the fitting function of equation (3) using the method of least squares on the skirt area, which is stored in the skirt area storage unit 507 and indicated by the two-dimensional reflection image data, thereby calculating a, b, and r.

In step S611, the representative position specification unit 504 identifies the representative position of the skirt area based on a result of the fitting processing. A peak position of the pixel values of the two-dimensional reflection image in the Gaussian distribution corresponds to the center position of the skirt area. In the present exemplary embodiment, the representative position is set to y-axis-b of the center position of the skirt area.

Figure 7E:
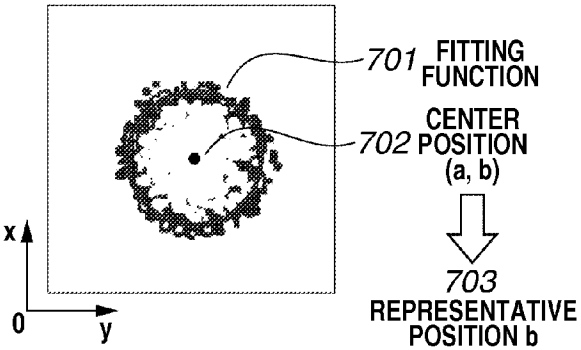

FIG. 7E illustrates results of the fitting processing performed by using equation (3) with respect to the skirt area of FIG. 7D and identification processing performed with respect to the representative position. In FIG. 7E, a fitting function 701 having a center position (a, b) 702 is calculated with respect to the skirt area and the y-axis-b of the center position (a, b) is identified as the representative position.

In step S613, the representative position specification unit 504 determines whether or not all the representative positions required for determining the toner height are identified. In order to determine the toner height, at least one representative position is required for each of the image bearing member 101/106 and the toner image 108.

In step S613, in a case where the representative position specification unit 504 determines that all the representative positions required for determining the toner height are identified (YES in step S613), the processing proceeds to step S615. On the other hand, in a case where the representative position specification unit 504 determines that all the representative positions required for determining the toner height are not identified (NO in step S613), the processing proceeds to step S614. In step S614, the image bearing member 101/106 is driven to the next image capturing point and the processing subsequent to step S601 is repeated.

In step S615, a toner height determination unit 505 obtains the toner height based on the representative position $b_0$ of the image bearing member 101/106 and the representative position $b_1$ of the toner image 108. As illustrated in FIGS. 4A through 4D, the reflecting position varies according to the height of the toner image and an image capturing position of the reflection image in the two-dimensional sensor varies.

In the present exemplary embodiment, as the height of the toner image becomes higher, a reflection image moves in a positive y-axis direction. Therefore, a value of a representative position b of the two-dimensional reflection image varies according to the toner height.

By calculating a difference between the representative position $b_0$ of the image bearing member 101/106 and the representative position $b_1$ of the toner image 108, an amount of movement ΔL of the representative position caused by the effect of the toner height is derived.

$$\Delta L = b_1 - b_0 \tag{4}$$

Since a unit of the representative position b is a pixel, a unit of ΔL is also a pixel. Provided that a pixel pitch of the two-dimensional sensor is p (μm/pixel), an optical magnification of the light receiving lens 303 is M, and a laser incident angle is θ, the toner height Δh can be determined as follows.

$$\Delta h = \frac{\Delta L \cdot p}{M \tan\theta} \tag{5}$$

Hereinabove, a method of determining the toner height Δh based on the two-dimensional image data captured by the two-dimensional sensor 304 is described.

The surfaces of the image bearing member 101/106 and the toner image 108 include minute surface asperities and streaky scratches due to the rotation in a circumferential direction. Therefore, the reflectance varies according to the sample position. As a result, a noise due to the variation of the reflectance may be included in the toner height to be measured. In order to minimize an adverse effect of the noise, a measurement of the toner height based on more pieces of sample data is demanded.

The conventional profilometer measures the toner height using one-dimensional pixel value information obtained by a line sensor. On the other hand, in the present exemplary embodiment, the toner height is measured by using the two-dimensional image data captured by the two-dimensional area sensor.

Accordingly, in comparison with a case of measuring the height by using the line sensor of the conventional profilometer, if the height is measured by using the two-dimensional sensor according to the present exemplary embodiment, the height can be measured based on more pieces of sample data (i.e., data of the skirt area of FIG. 7D). Therefore, according to the present exemplary embodiment, the height of the toner image formed on the image bearing member 101/106 can be measured with high accuracy.

In an example of the processing flow of FIG. 6, the representative position $b_0$ corresponding to the image bearing member 101/106 and the representative position $b_1$ corresponding to the toner image 108 are identified from a single piece of two-dimensional image data, respectively.

However, in order to reduce the adverse effect of the surface asperities and the scratches of the surfaces of the image bearing member 101/106 and the toner image 108, for example, a plurality of representative positions are identified with respect to a single toner image, and the plurality of representative positions are averaged to obtain an averaged representative position $b_1'$. Similarly, an averaged representative position $b_0'$ is also calculated with respect to the representative position $b_0$ corresponding to the image bearing member 101/106.

A use of these averaged representative positions $b_1'$ and $b_0'$ instead of $b_1$ and $b_0$ in equation (4) enables a highly accurate determination of the toner height.

The toner height Δh is calculated by obtaining a difference between the representative position $b_0$ of the image bearing member 101/106 and the representative position $b_1$ of the toner image 108 in the present exemplary embodiment. However, it is not limited thereto. The toner height Δh may be calculated only from the representative position $b_1$ of the toner image 108 regarding that the representative position $b_0$ of the image bearing member 101/106 is constant.

The beam shape information stored in the beam shape information storage unit 503 is not limited to the fitting function indicating the circle represented by equation (3). For example, the fitting function indicating an oval as described below is also employable.

$$\frac{(x-a)^2}{s^2} + \frac{(y-b)^2}{t^2} = 1 \tag{6}$$

(s, t) is a parameter representing a long side/short side of the oval and (a, b) is a parameter representing a center of the oval.

The representative position specification unit 504 uses, but not limited thereto, the center position of the circle when identifying the representative position. For example, in the circle having been subjected to the fitting processing, the maximum y-axis coordinate value (b+r) may be set as the representative position.

The amount of movement ΔL of the representative position is set to, but not limited to, the amount of movement $b_1$-$b_0$ of the center position b in the y-axis direction. For example, in a case where the representative position moves also in an x-axis direction due to an mounting error or the like of the two-dimensional sensor 304, the amount of movement ΔL may be derived as described below.

$$\Delta L = \sqrt{(a_1 - a_0)^2 + (b_1 - b_0)^2} \tag{7}$$

$(a_1, b_1)$ is an x-y coordinates of the representative position corresponding to the image bearing member 101/106 and $(a_0, b_0)$ is the x-y coordinates of the representative position corresponding to the toner image 108. By using equation (7), more accurate toner height Δh can be determined.

The skirt area detection threshold storage unit 506 stores, but not limited thereto, the upper threshold $R_{max}$ and the lower threshold $R_{min}$. For example, the skirt area detection threshold storage unit 506 may store a center threshold $R_{center}$ and a width threshold $R_{width}$. In this case, the skirt area detection unit 502 calculates the upper pixel threshold $Th_{max}$ and the lower pixel threshold $Th_{min}$ by the following equation.

$$Th_{max}=R_{center}\times A+R_{width} \quad (8)$$

$$Th_{min}=R_{center}\times A-R_{width} \quad (9)$$

The upper pixel threshold $Th_{max}$ and the lower pixel threshold $Th_{min}$ may be obtained independently from the maximum pixel value A. In other words, the skirt area detection threshold storage unit 506 may store the upper pixel threshold $Th_{max}$ and the lower pixel threshold $Th_{min}$, and the skirt area detection unit 502 may detect the skirt area based on the above thresholds.

The laser beam incident angle θ may be set to a value other than 45°. The laser beam may be set in such a manner that the laser beam is emitted in a vertical direction with respect to the reflection surface (i.e., positive z-axis direction), and the two-dimensional sensor 304 tilts by the angle 45°.

Each processing of the present exemplary embodiment includes, for example, the calculation using equations (1) through (5), but the calculation may be substituted with a lookup table. For example, the lookup table in which an input is a combination of $R_{max}$ and A, and an output is $Th_{max}$ may be used as a substitution of the computation performed by equation (1).

Now, a description is made as to a method for detecting a skirt portion of the reflection image by irradiating the surface of the image bearing member 101/106 and the surface of the toner image 108 with light using a light-emitting diode light source (hereinafter referred to as LED light source) according to a second exemplary embodiment. In the present exemplary embodiment, configurations identical to those of the first exemplary embodiment are provided with the same reference numbers/symbols and the descriptions thereof are omitted here.

Figure 10:
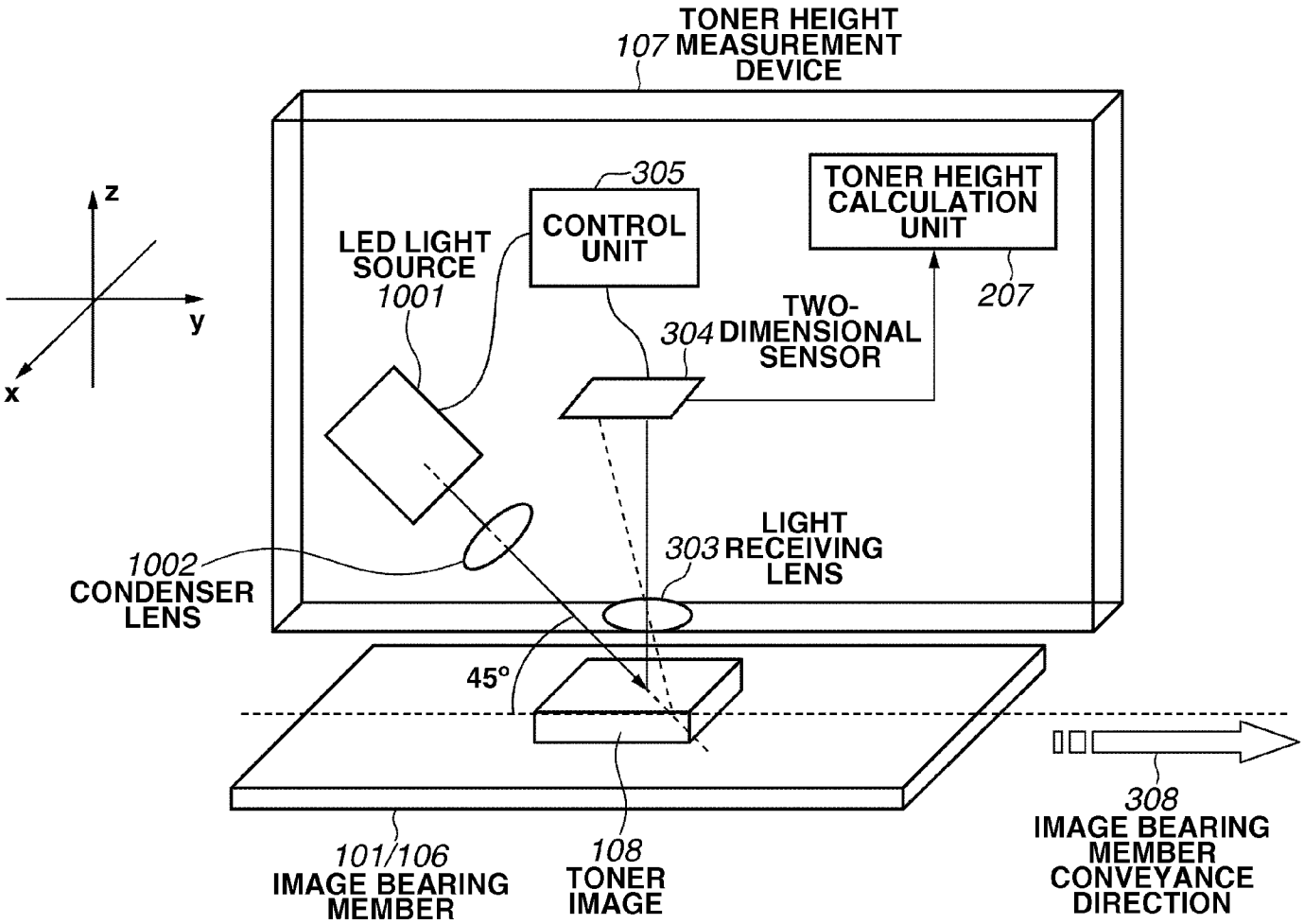
FIG. 10 illustrates the positional relationship of the toner height measurement device with respect to the image bearing member and the toner image according to a second exemplary embodiment.

FIG. 10 illustrates a configuration of the toner height measurement device 107 in a case where an LED light source 1001 is used. The LED light source 1001 includes a condenser lens 1002 for forming an image of the LED light source at predetermined magnification.

Figure 8A:
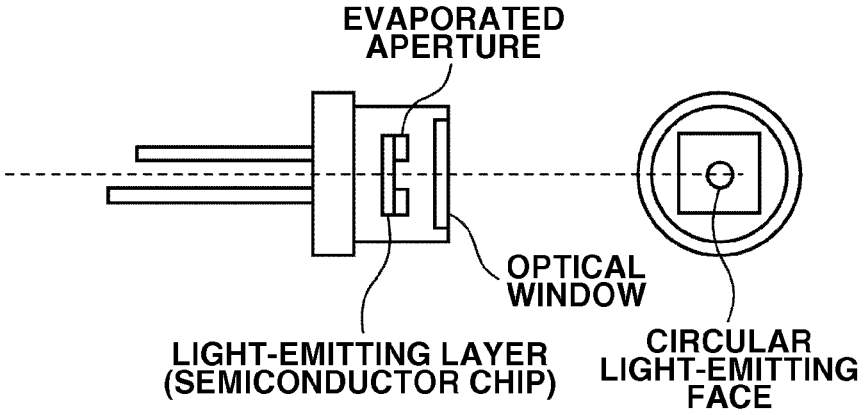
FIGS. 8A to 8C each illustrate a configuration of an LED light source.

The LED light source 1001 used in the present exemplary embodiment is provided with a mask evaporated on a luminescent layer of a semiconductor chip so that a desired light-emitting face shape can be obtained, in order to control the two-dimensional reflection image when the light irradiates the surface of the image bearing member 101/106 or the surface of the toner image 108 (FIG. 8A).

Figure 8B:
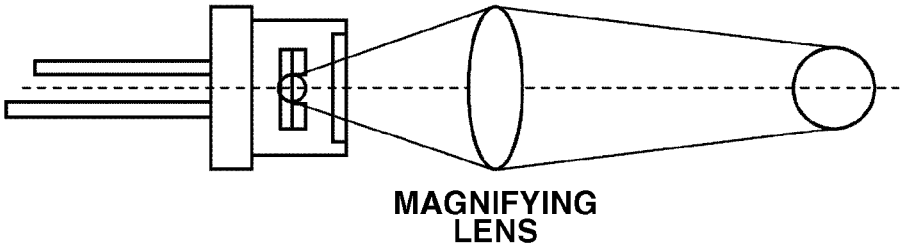

More specifically, an evaporated film is formed so that a circular light-emitting face of a size of ϕ50 μm is exposed around a center of the light-emitting face. The circular light-emitting face of ϕ50 μm is magnified twice by using a magnifying lens in FIG. 8B, thereby enabling the magnified circular light-emitting face to irradiate the measurement surface with a circular spot of a size of ϕ100 μm.

Figure 8C:
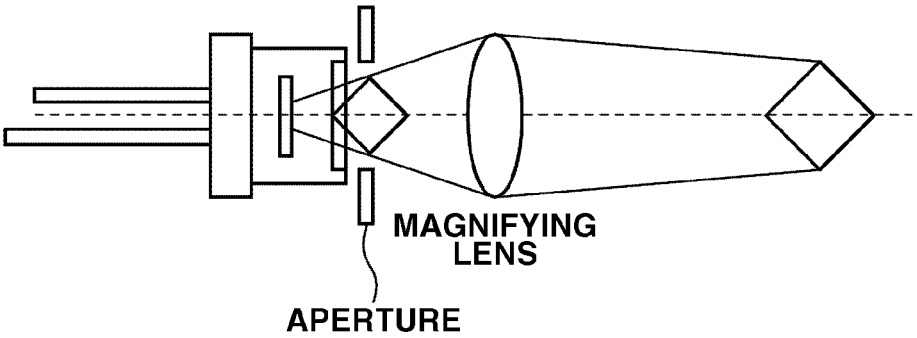

The beam shape after the light beam is condensed in the present exemplary embodiment is not limited to the circular shape, and the circular shape or the oval shape as described in the first exemplary embodiment. It may be, for example, a rhombus shape as illustrated in FIG. 8C. The beam shape may be controlled by, for example, placing an optical member such as an aperture immediately after the LED light source other than the evaporation of the mask on the chip.

Now, a method for detecting the skirt area from the two-dimensional reflection image by using an optical method according to a third exemplary embodiment is described below. In the present exemplary embodiment, the configurations identical to those of the first and second exemplary embodiments are provided with the same reference numbers/symbols and descriptions thereof are omitted here.

Figure 9:
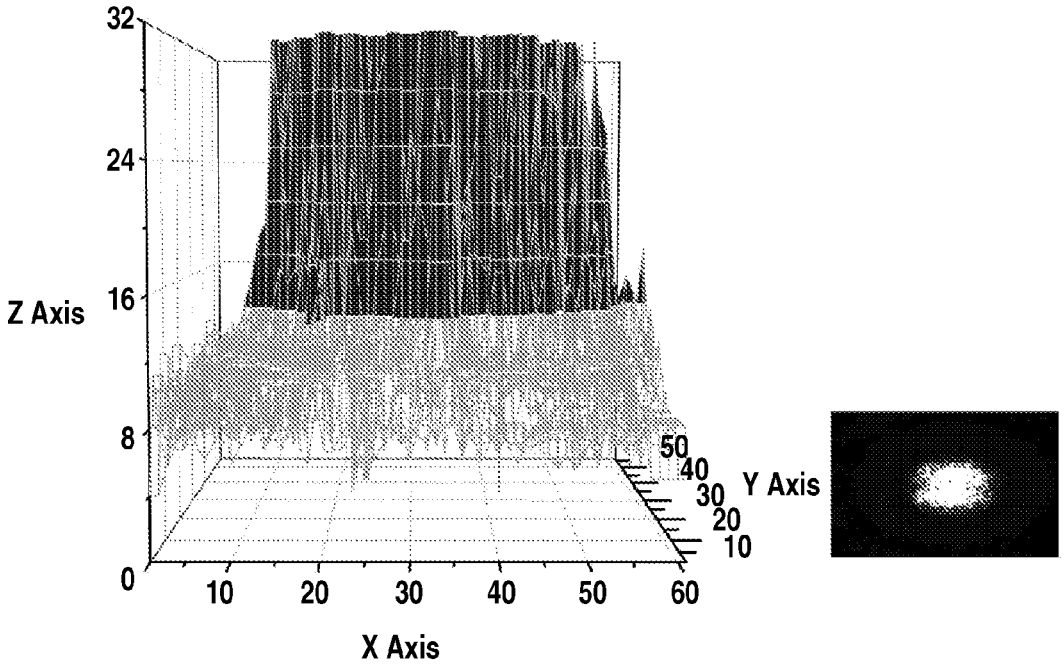
FIG. 9 illustrates two-dimensional image data according to a third exemplary embodiment.

An example of the two-dimensional image date is illustrated in FIG. 9. In the present exemplary embodiment, the control unit 305 controls a light source power or sensitivity and an exposure time of the two-dimensional sensor 304 to saturate a portion of the pixel values. If the pixels having the saturated pixel values are regarded as pixels having no values, the two-dimensional image data having the skirt area illustrated in FIG. 7D can be captured as the result.

The two-dimensional image data is stored in the skirt area storage unit 507. As a result thereof, the skirt area detection unit 502 for detecting the skirt area can be simplified. Since amplitude itself of the sensor output signals becomes larger, designing of the amplifier of the latter stage becomes easier, and bit accuracy when converting the signals into digital signals with analogue/digital (A/D) converter can be improved.

A method for detecting the skirt area from the two-dimensional reflection image by using an electric method according to a fourth exemplary embodiment is described below. In the present exemplary embodiment, configurations identical to those of the first to third exemplary embodiments are provided with the same numbers/symbols and the descriptions thereof are omitted here.

Figure 11:
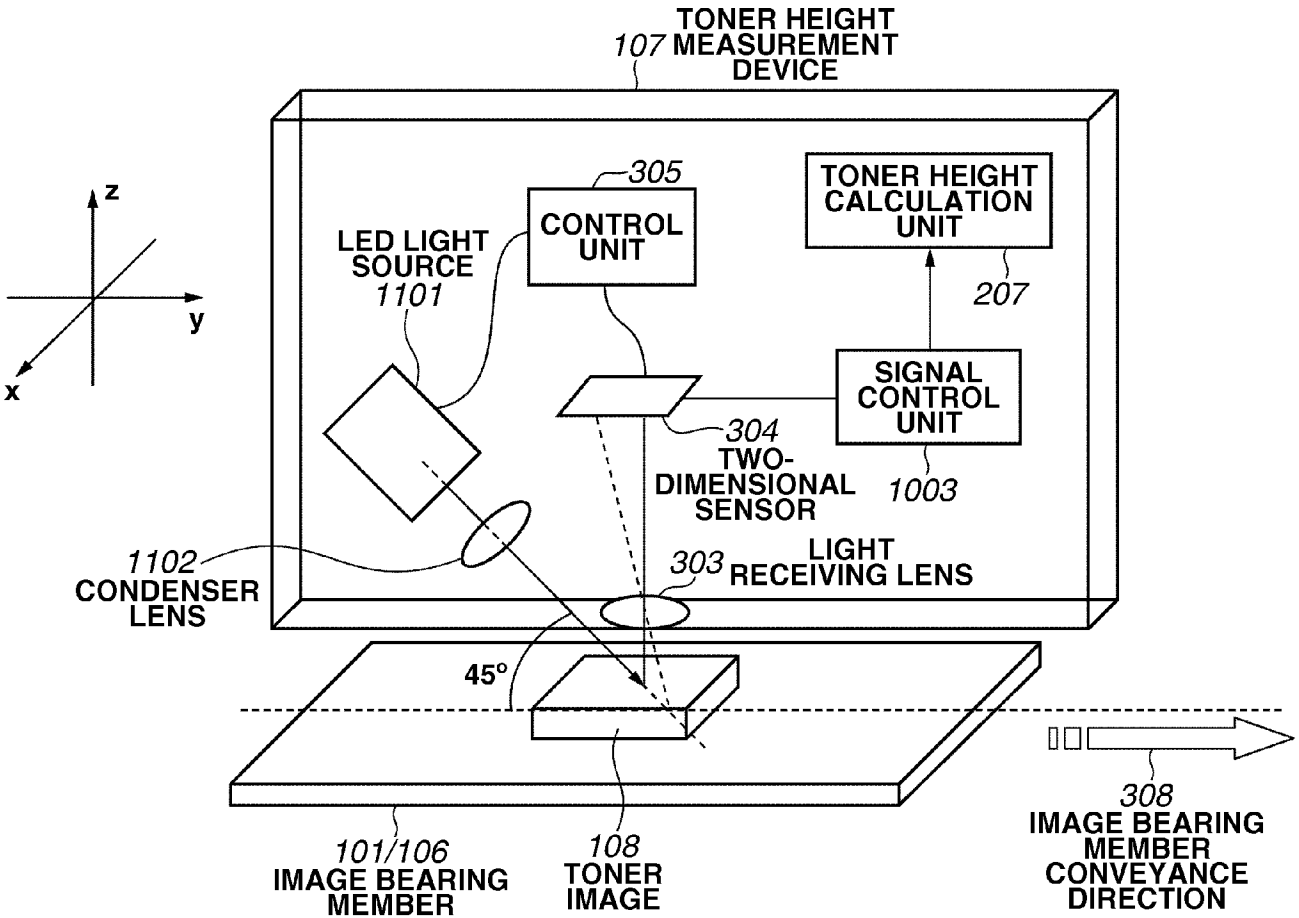
FIG. 11 illustrates the positional relationship of the toner height measurement device with respect to the image bearing member and the toner image according to a fourth exemplary embodiment.

FIG. 11 illustrates a configuration of the toner height measurement device 107 according to the present exemplary embodiment. By limiting a voltage or a current with respect to the signals output from the two-dimensional sensor 304 by the signal control unit 1003, a portion of the two-dimensional image data is clipped to electrically detect only the skirt area.

A signal control unit 1103 may be an analog device such as an amplifier or a regulator. Alternatively, the signal control unit 1003 may have a configuration that, after a conversion into digital signals by using the A/D converter, only lower bits of the digital signals representing a relatively low voltage of the skirt area are detected.

Now, a fifth exemplary embodiment is described below. In the present exemplary embodiment, the representative position is detected by calculating a centroid of the two-dimensional reflection image in the two-dimensional image data captured by the two-dimensional sensor 304. In the present exemplary embodiment, configurations identical to those of the first to fourth exemplary embodiments are provided with the same numbers/symbols and the descriptions thereof are omitted here.

Figure 13:
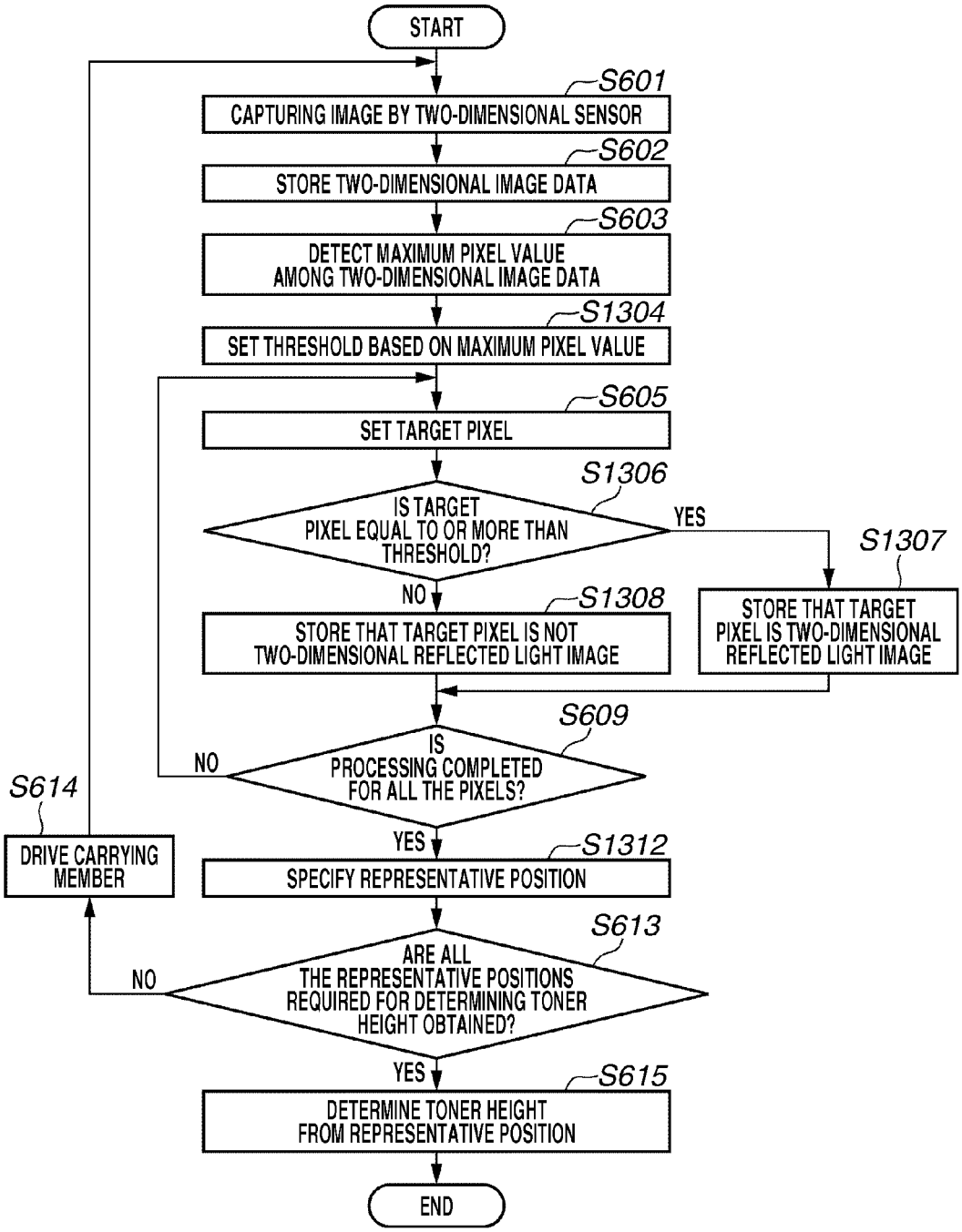
FIG. 13 is a flowchart illustrating a flow of processing performed by the toner height calculation unit according to a fifth exemplary embodiment.
Figure 15:
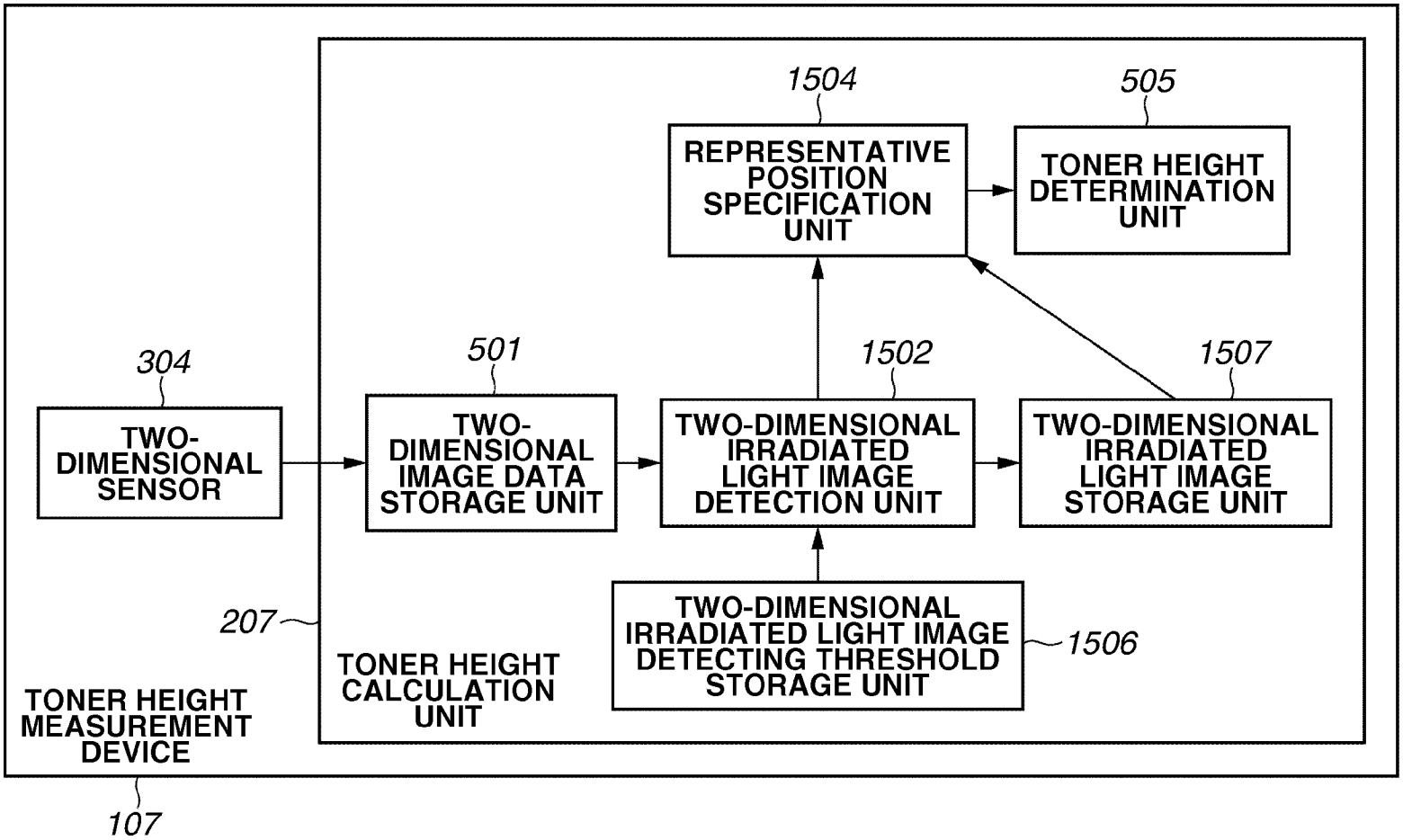
FIG. 15 is a block diagram illustrating a configuration of the main part of the toner height measurement device according to the fifth exemplary embodiment.

FIG. 13 illustrates a processing flow of the present exemplary embodiment. FIG. 15 illustrates a configuration of the toner height measurement device 107 according to the present exemplary embodiment.

In step S1304, an irradiated light image detection unit 1502 sets a threshold for identifying a centroid position based on threshold information and the maximum pixel value A stored in an irradiated light image detecting threshold storage unit 1506.

The threshold is the threshold for detecting the two-dimensional reflection image. If the pixel value of the target pixel is equal to or more than the threshold, the irradiated light image detection unit 1502 determines that the target pixel is a part of the two-dimensional reflection image. If the pixel value of the target pixel is less than the threshold, the irradiated light image detection unit 1502 determines that the target pixel is not a part of the two-dimensional reflection image.

In step S1306, the irradiated light image detection unit 1502 determines whether or not the pixel value of the target pixel is equal to or more than the threshold set in step S1304. In step S1306, in a case where the irradiated light image detection unit 1502 determines that the pixel value of the target pixel is equal to or more than the threshold set in step S1004 (YES in step S1306), the processing proceeds to step S1307. In a case where the irradiated light image detection unit 1502 determines that the pixel value of the target pixel is less than the threshold set in step S1004 (NO in step S1306), the processing proceeds to step S1308.

In step S1307, the irradiated light image detection unit 1502 stores information indicating that the target pixel is the part of the two-dimensional reflection image in an irradiated light image storage unit 1507. On the other hand, in step S1308, the irradiated light image detection unit 1502 stores information indicating that the target pixel is not a part of the two-dimensional reflection image in the irradiated light image storage unit 1507.

Figure 14:
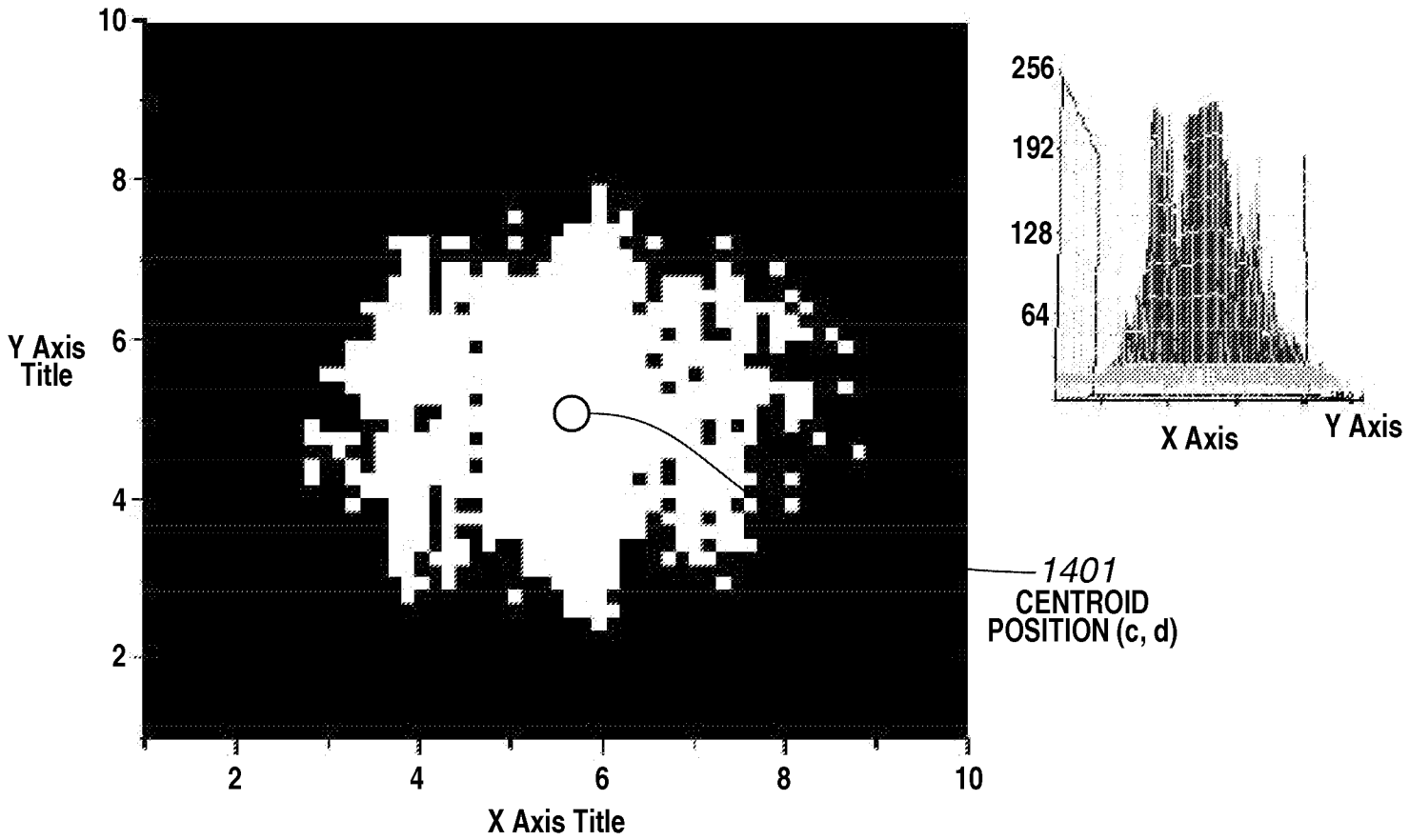
FIG. 14 illustrates two-dimensional image data according to the fifth exemplary embodiment.

As a result of the processing performed in steps S1307 and S1308, the irradiated light image storage unit 1507 stores the two-dimensional reflection image data indicating whether or not each pixel is a part of the two-dimensional reflection image. FIG. 14 illustrates a two-dimensional reflection image indicated by the two-dimensional reflection image data stored in the irradiated light image storage unit 1507.

In step S1312, a representative position specification unit 1504 calculates a centroid position 1401 (c, d) of the two-dimensional reflection image. A coordinate d of y-axis of the centroid position is set to be a representative position, and the representative position specification unit 1504 determines the toner height in the same manner as it is performed in the first exemplary embodiment.

Similar to the first exemplary embodiment, in the present exemplary embodiment, the representative position specification unit 1504 can determine the height of the toner image formed on the image bearing member 101/106 with high accuracy. In the first exemplary embodiment, the fitting processing is required in order to identify the representative position. However, in the present exemplary embodiment, the representative position specification unit 1504 can identify the representative position by merely calculating the centroid position, so that a calculation cost can be reduced.

Now, a sixth exemplary embodiment is described below. In the present exemplary embodiment, a method for obtaining a two-dimensional image by using a one-dimensional line sensor, but not the two-dimensional area sensor, and a scanning mechanism of the one-dimensional line sensor. In the present exemplary embodiment, configurations identical to those of the first through fifth exemplary embodiments are provided with the same numbers/symbols, and descriptions thereof are omitted here.

Figure 16:
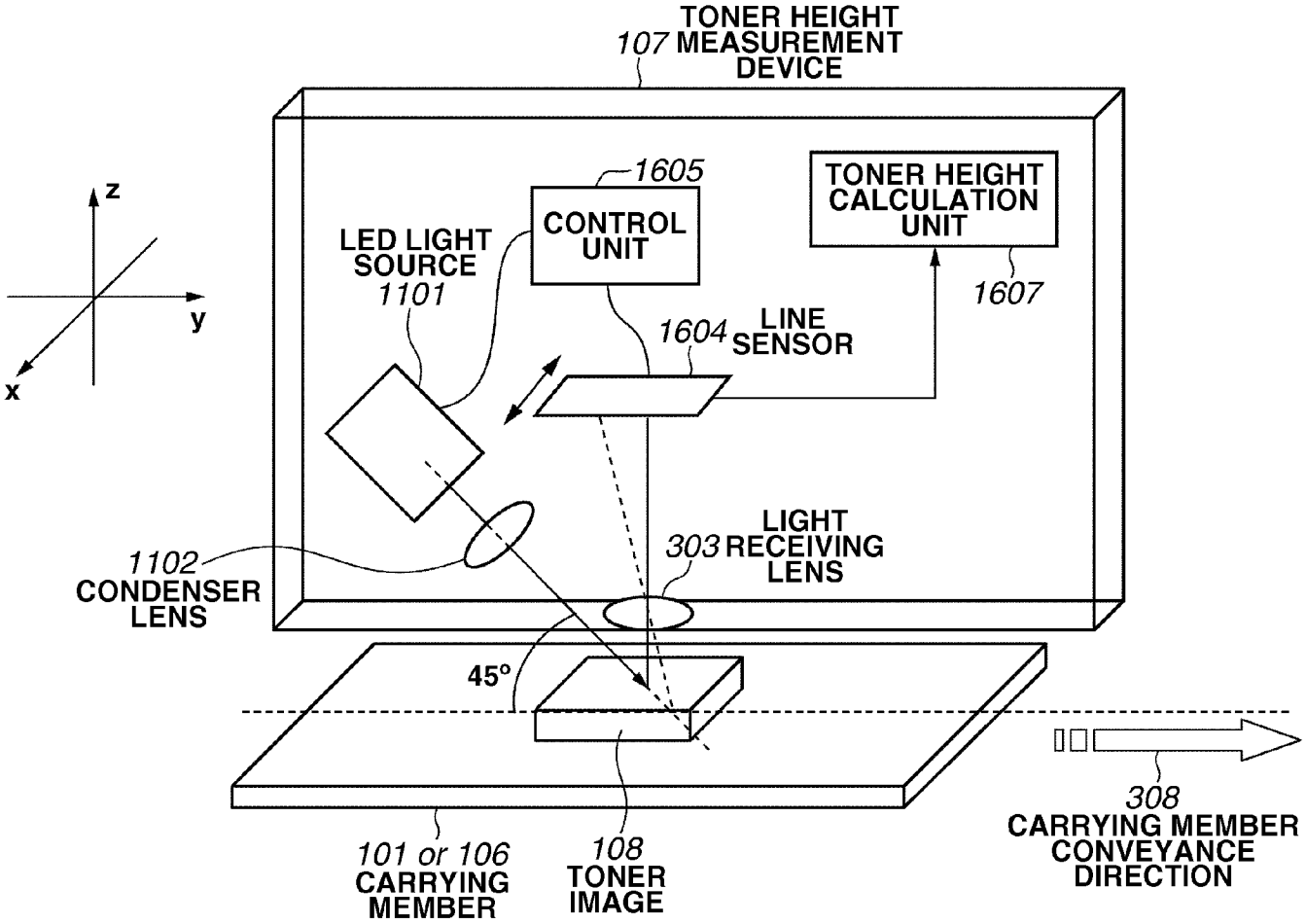
FIG. 16 illustrates the positional relationship of the toner height measurement device with respect to the image bearing member and the toner image according to a sixth exemplary embodiment.

FIG. 16 illustrates a configuration of the toner height measurement device 107 according to the present exemplary embodiment. A line sensor 1604 includes a reed shaped light receiving surface and pixels aligning on the reed shape in a longitudinal direction thereof. The longitudinal direction is in parallel with a Y-axis direction in FIG. 16, so that movement of the reflection spot in the Y-axis direction when the height varies can be detected.

In the present exemplary embodiment, in order to obtain the two-dimensional image, the toner height measurement device 107 includes a line sensor 1604 oriented in the above described direction and a control unit 1605 for driving the line sensor 1604 to any position in an X-axis direction in FIG. 16.

Figure 17:
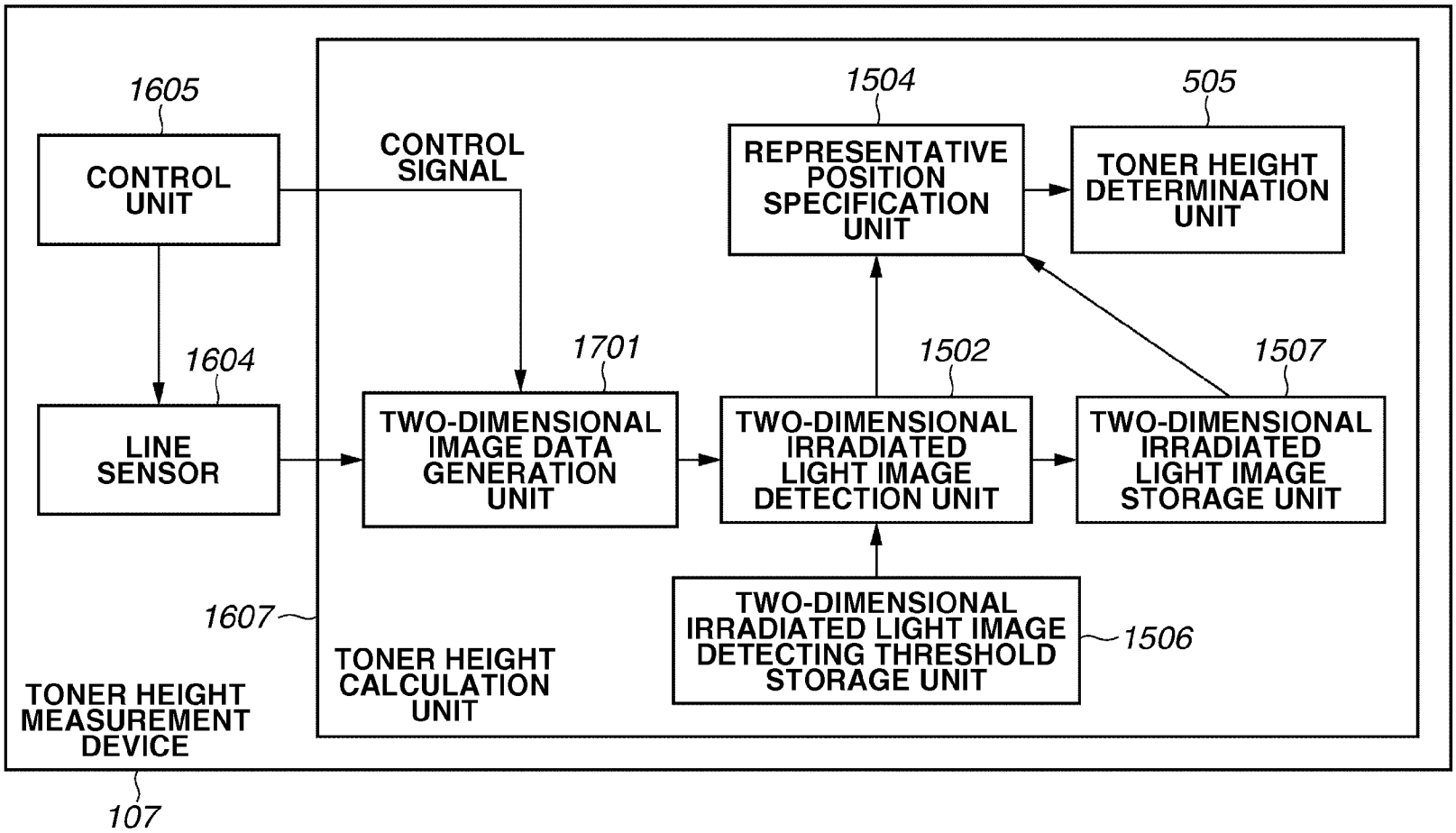
FIG. 17 is a block diagram illustrating a configuration of the main part of the toner height measurement device according to the sixth exemplary embodiment.

FIG. 17 is a block diagram illustrating a toner height calculation unit 1607 according to the present exemplary embodiment. The control unit 1605 drives the line sensor 1604 in a certain constant image capturing time as well as sequentially moves the line sensor 1604 in the X-axis direction at a regular interval, thereby capturing a time series one-directional image capturing waveform.

The captured images and timing signals of the movement at the time are input in a two-dimensional image data generation unit 1701, and a desired two-dimensional image is generated by synchronizing a time shared data of the one-dimensional image capturing waveform with the timing signals to rearrange the time shared data. The toner height is calculated by calculating the center or the centroid from the generated two-dimensional image.

The present invention can be realized in such a manner that a computer readable recording medium that records computer program codes of software for realizing the functions of the first through sixth exemplary embodiments (e.g., functions exemplified by the flow charts) is supplied to a system or an apparatus. In this case, a computer (or a CPU or a MPU) of the system or the apparatus reads out and executes the program codes stored in the computer readable recording medium, thereby realizing the functions of the above described exemplary embodiments.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims the benefit of Japanese Patent Applications No. 2010-267291 filed Nov. 30, 2010 and No. 2011-184617 filed Aug. 26, 2011, which are hereby incorporated by reference herein in their entirety.

What is claimed is:

1. An information processing apparatus for determining a height of a toner image formed on an image bearing member, comprising:

an obtaining unit configured to obtain first image data obtained by capturing a beam emitted by an emission unit and reflected on the toner image;

a detection unit configured to detect pixels having pixel values included in a predetermined range from the first image data obtained by the obtaining unit wherein the predetermined range is less than a maximum value in the first image data;

an identification unit configured to identify a representative position of the first image data based on a center position of a shape by fitting said pixels detected in the first image data by the detection unit; and a determination unit configured to determine the height of the toner image from the representative position identified by the identification unit.

2. The information processing apparatus according to claim 1, wherein the detection unit detects said pixels by subjecting the first image data to threshold value processing.

3. The information processing apparatus according to claim 1, further comprising:

a storage unit configured to store shape information, wherein the identification unit identifies the representative position of the first image based on said pixels detected by the detection unit and the shape information stored in the storage unit.

4. The information processing apparatus according to claim 1, wherein the obtaining unit obtains second image data obtained by capturing a beam emitted by the emission unit and reflected on the image bearing member, wherein the detection unit detects pixels having pixel values included in a predetermined range from the second image data, wherein the identification unit identifies a representative position of the second image data based on a center position of a shape by fitting said pixels detected in the second image data by the detection unit, and wherein the determination unit determines the height of the toner image based on the representative position in the first image data and the representative position in the second image data.

5. The information processing apparatus according to claim 4, wherein the shape information indicates a function of a circle or an oval.

6. The information processing apparatus according to claim 1, wherein the identification unit identifies a centroid position of the shape as the representative position.

7. The information processing apparatus according to claim 2, wherein the threshold value processing is processing including an upper threshold and a lower threshold.

8. The information processing apparatus according to claim 2, wherein a threshold used in the threshold value processing is set based on the maximum pixel value of the first image data.

9. The information processing apparatus according to claim 1, wherein the first image data is obtained according to image capturing processing by using a two-dimensional sensor.

10. The information processing apparatus according to claim 1, wherein the first image data is obtained according to image capturing processing by using a one-dimensional sensor.

11. An image forming apparatus configured to control an image-forming process by using the information processing apparatus according to claim 1.

12. A non-transitory computer-readable storage medium that stores a program for causing a computer to function as a unit included in the information processing apparatus according to claim 1.

13. An information processing method for determining a height of a toner image formed on an image bearing member, comprising:

obtaining with an obtaining unit configured to obtain first image data obtained by capturing a beam emitted by an emission unit and reflected on the toner image;

detecting with a detection unit configured to detect pixels having pixel values included in a predetermined range from the first image data obtained by the obtaining unit wherein the predetermined range is less than a maximum value in the first image data;

identifying with an identification unit configured to identify a representative position of the first image data based on a center position of a shape by fitting said pixels detected in the first image data by the detection unit; and determining with a determination unit configured to determine the height of the toner image from the representative position identified by the identification unit.

* * * * *